US008967270B2

(12) United States Patent
Desai et al.

(10) Patent No.: US 8,967,270 B2
(45) Date of Patent: Mar. 3, 2015

(54) RIGLESS ABANDONMENT SYSTEM

(75) Inventors: Praful C. Desai, Kingwood, TX (US); Lawrence Barr, Houston, TX (US); Anton J. Dach, III, Arlington, TX (US)

(73) Assignee: Smith International, Inc., Houston, TX (US)

( * ) Notice: Subject to any disclaimer, the term of this patent is extended or adjusted under 35 U.S.C. 154(b) by 356 days.

(21) Appl. No.: 12/646,077

(22) Filed: Dec. 23, 2009

(65) Prior Publication Data

US 2010/0163244 A1 Jul. 1, 2010

Related U.S. Application Data

(60) Provisional application No. 61/141,991, filed on Dec. 31, 2008.

(51) Int. Cl.
*E21B 29/12* (2006.01)
*E21B 23/14* (2006.01)
*E21B 41/04* (2006.01)

(52) U.S. Cl.
CPC ..... *E21B 29/12* (2013.01); *E21B 23/14* (2013.01); *E21B 41/04* (2013.01)
USPC ..... 166/361; 166/341; 166/352; 166/297; 166/298; 166/363

(58) Field of Classification Search
USPC ..... 166/361, 341, 352, 297, 298, 54.6, 55, 166/55.1, 55.6
See application file for complete search history.

(56) References Cited

U.S. PATENT DOCUMENTS

| | | | | |
|---|---|---|---|---|
| 3,225,826 | A * | 12/1965 | Postlewaite | 166/352 |
| 4,703,802 | A * | 11/1987 | Bryan et al. | 166/298 |
| 5,107,931 | A * | 4/1992 | Valka et al. | 166/342 |
| 6,357,528 | B1 | 3/2002 | Davis et al. | |
| 6,484,806 | B2 | 11/2002 | Childers et al. | |
| 6,554,073 | B2 | 4/2003 | McGarian | |
| 7,104,330 | B2 | 9/2006 | Legras et al. | |
| 2002/0023755 | A1 * | 2/2002 | McGarian | 166/361 |

(Continued)

OTHER PUBLICATIONS

Notification of Transmittal of the International Search Report and the Written Opinion of the International Searching Authority, or the Declaration as issued in related International Patent Application No. PCT/US2009/069850; Dated Aug. 16, 2010 (8 pages).

(Continued)

*Primary Examiner* — James G Sayre
(74) *Attorney, Agent, or Firm* — Osha Liang LLP

(57) ABSTRACT

A rigless abandonment system including a surface vessel having an attached lifting device and a moonpool. The system further includes a cutting module configured to connect to a subsea wellhead, the cutting module having a wellhead connector having an actuatable lock and release mechanism, a motor assembly, and a cutter. An umbilical line connects the cutting module to the surface vessel, wherein the lifting device is used to raise and lower the cutting module connected to the surface vessel through the moonpool. A method for performing rigless casing cutting and wellhead removal operations, the method includes positioning a surface vessel above a subsea wellhead, where the surface vessel has a moonpool and a lifting device. The method further includes providing a cutting module, and deploying the cutting module through the moonpool, wherein the cutting module is connected to the surface vessel by an umbilical line.

19 Claims, 5 Drawing Sheets

(56) References Cited

U.S. PATENT DOCUMENTS

| | | | | |
|---|---|---|---|---|
| 2005/0145389 | A1* | 7/2005 | Barrow et al. | 166/361 |
| 2007/0253778 | A1* | 11/2007 | Figenschou | 405/169 |

OTHER PUBLICATIONS

Examination Report issued Jul. 19, 2012 in corresponding New Zealand application No. 594303 (2 pages).

Patent Examination Report No. 1 issued Nov. 9, 2012 in corresponding Australian application No. 2009334509 (3 pages).

Examination Report issued Nov. 8, 2013 in corresponding GB application No. GB1113098.6 (2 pages).

Notice of Acceptance dated Nov. 1, 2013 in corresponding Australian application No. 2009334509 (1 page).

Notice of Acceptance dated Nov. 6, 2013 in corresponding New Zealand application No. 594303 (1 page).

* cited by examiner

RIGLESS ABANDONMENT SYSTEM

CROSS-REFERENCE TO RELATED APPLICATIONS

This application, pursuant to 35 U.S.C. §119(e), claims priority to U.S. Provisional Application Ser. No. 61/141,991, filed Dec. 31, 2008. That application is incorporated by reference in its entirety.

BACKGROUND OF THE INVENTION

1. Field of the Invention

Embodiments disclosed herein relate generally to the removal of subsea wellhead assemblies and, more particularly, to the cutting of well casing below a wellhead to enable removal of the wellhead. Specific embodiments relate to cutting the casing and removing the wellhead in a single trip.

2. Description of the Related Art

When an oil or gas well is to be abandoned, government regulations usually require removal of the wellhead. The usual procedure includes steps such as plugging the well with a suitable cement composition, testing the integrity of the plug, and then removing the wellhead assembly. On land, the wellhead assembly can be removed by standard construction techniques and in general, the casing immediately below the wellhead will be cut off several meters below ground level to allow reinstatement of the well site. However, this technique cannot satisfactorily be applied to subsea wells as casings often need to be cut underwater, in situ.

In the case of a subsea well, abandonment usually entails plugging the well bore with cement and then detonating an explosive charge within the well casing slightly below the level of the wellhead in order to cut the casing at that point and free the wellhead assembly for removal. This technique is unsatisfactory because portions of the wellhead removed after explosive cutting can become damaged and not suitable for re-use.

When the use of explosives is not available or desired, other techniques involve severing the casing with a mechanical or hydraulic cutting apparatus. For example, a cutting apparatus is lowered from the surface towards a wellhead, often requiring the assistance of divers or a remotely operated vehicle to affix the apparatus to the wellhead. Once the connection is established, the cutting apparatus is activated to cut the casing. Upon completion of the cutting, the apparatus is disconnected from the wellhead, and raised to the surface. Then, another device or apparatus is subsequently lowered to the wellhead, such that it can affix to the wellhead. Then, the device and wellhead in combination can be raised to the surface. The need for multiple trips is time consuming and inefficient.

Accordingly, there exists a need for an improved cutting module that can perform rigless abandonment operations. There also exists a need for an improved cutting module that can perform a wellhead removal operation in a single trip.

SUMMARY OF INVENTION

In one aspect, embodiments disclosed herein relate to a rigless abandonment system that includes a surface vessel having an attached lifting device and a moonpool. The system further includes a cutting module configured to connect to a subsea wellhead, with the cutting module having a wellhead connector having an actuatable lock and release mechanism, a motor assembly, and a cutter. An umbilical line connects the cutting module to the surface vessel, wherein the lifting device is used to raise and lower the cutting module connected to the surface vessel through the moonpool.

In another aspect, embodiments disclosed herein relate to a method for performing rigless casing cutting and wellhead removal operations, the method includes positioning a surface vessel above a subsea wellhead, with the surface vessel having a moonpool and a lifting device. The method includes providing a cutting module having a wellhead connector having an actuatable lock and release mechanism, a motor assembly comprising a secured motor, and a cutter operatively connected to an output shaft of the motor assembly. The method further includes deploying the cutting module through the moonpool, wherein the cutting module is connected to the surface vessel by an umbilical line, guiding the cutting module into an operative position so that the cutter is located within a casing, actuating the lock and release mechanism to secure the cutting module to the subsea wellhead, expanding the cutter into engagement with the casing, and operating the motor to rotate the output shaft and cutter to cut the casing.

Other aspects and advantages of the invention will be apparent from the following description and the appended claims.

BRIEF DESCRIPTION OF DRAWINGS

A full understanding of embodiments disclosed herein is obtained from the detailed description of the disclosure presented hereinbelow, and the accompanying drawings, which are given by way of illustration only and are not intended to be limitative of the present embodiments, and wherein.

DETAILED DESCRIPTION

Figure 1:
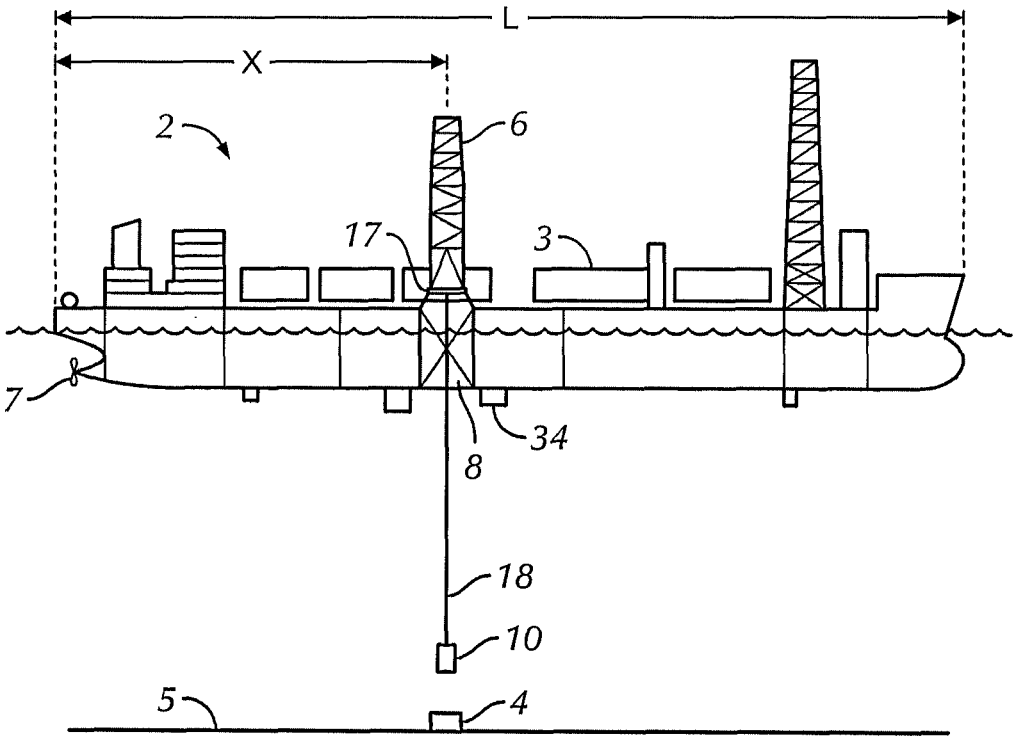
FIG. 1 shows a schematic representation of the abandonment system, in accordance with embodiments of the present disclosure.

Referring to the FIG. 1, schematic representation of a rigless abandonment system according to embodiments of the present disclosure, is shown. In this embodiment, a rigless abandonment system may include a surface vessel 2 positioned over a subsea wellhead 4 located on the sea floor 5. The use of the term subsea wellhead is not meant to be limiting, and for simplicity, may be referred to as a "wellhead" in describing embodiments disclosed herein. In addition, while shown only as a wellhead 4, the wellhead 4 may be associated or connected with other common wellhead equipment, such as risers or a blow out preventer (BOP) (not shown).

The surface vessel 2 may be equipped with thrusters or a propeller system 7 to maintain the vessel 2 in an appropriate position and orientation to perform vessel operations. In one embodiment, the surface vessel 2 may be a drilling supply vessel ("DSV"). A DSV may provide multipurpose versatility and operational flexibility. For example, DSV's may provide floating, drilling, production, storage, and/or offloading capabilities. In some embodiments, DSV's may be used for pulling and/or carrying heavy loads. However, the type of vessel used in embodiments disclosed herein is not limited to a DSV.

Continuing with FIG. 1, the vessel 2 may be configured with at least one lifting device 6 that may be used for transferring loads to, from, and/or about the vessel 2. In one embodiment, the lifting device 6 may be a crane. In another embodiment, the lifting device 6 may be a mounted derrick. The vessel 2 may also be configured with a moonpool 8. The moonpool 8 may provide access to the sea, without the need to extend loads over an edge or side of the vessel 2. In other words, the lifting device 6 may be used for raising and lowering loads through the moonpool 8. In one embodiment, the lifting device 6 may raise and lower loads weighing up to 200,000 lbs. However, in other embodiments, the loads may exceed 200,000 lbs.

The moonpool 8 may be disposed within the surface vessel 2 in any number of locations (e.g., stern, aft, port, starboard, etc.), and is generally sufficient in width to allow deployment of large loads. In some embodiments, the lifting device 6 may be used to deploy a tool 10 through the moonpool 8. In further embodiments, the tool may be a cutting module 10 used for cutting casing. While the location of the moonpool 8 may be at any position on the vessel 2, the greatest amount of support for the lifting device 6 as it lowers a load through the moonpool may occur from a generally centralized position X. As depicted, the location of the central position X may be analogous to the midpoint (i.e., half-distance) of a vessel length L. In addition, greater support for the lifting device 6 may occur with the moonpool 8 also centralized with respect to a width (not shown) of the surface vessel 2.

Figure 2:
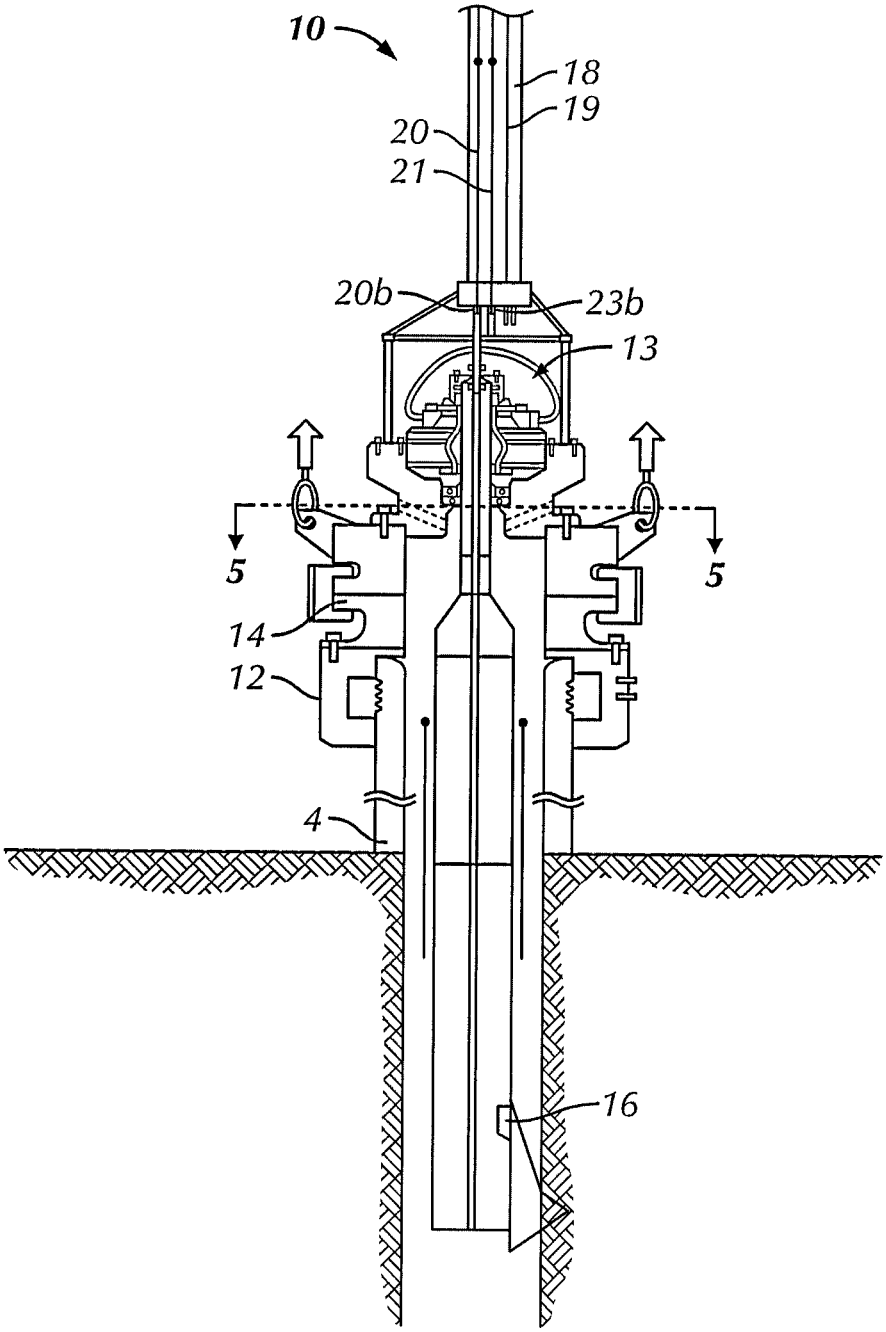
FIG. 2 shows a cross-section of a cutting module secured to a wellhead, in accordance with embodiments of the present disclosure.

Referring to FIG. 2, a cross-section of a cutting module secured to a wellhead according to embodiments of the present disclosure, is shown. In this embodiment, the cutting module 10 is illustrated after it has engaged the wellhead 4. Though the size of the cutting module 10 may vary depending upon the operation involved, the cutting module may have a general length in the range of 30 to 60 feet. In a specific embodiment, the cutting module may have a length in the range of 40 to 45 feet. The cutting module 10 may be configured to securely connect to the wellhead 4 via a wellhead connector 12. In one embodiment, the wellhead connector 12 may include an actuatable lock and release mechanism 14. In certain embodiments, the lock and release mechanism 14 may be hydraulically actuatable. The cutting module 10 may also include other features, such as a motor assembly 13 and a cutter 16. Controlled deployment of the cutting module 10 through the moonpool (not shown) may be accomplished by any means known in the art. For example, the controlled deployment of cutting module 10 may include the use of an umbilical line 18 operatively connected to the lifting device (not shown). The cutting module and features contained therein may be made from materials known in the art that are commonly used for subsea operations.

The umbilical line 18 may serve other purposes besides providing the connection between the cutting module 10 and the vessel (not shown). For example, the umbilical line 18 may be used as an isolated conduit, such that it provides a protective barrier surrounding other components internal to the umbilical line 18. The umbilical line 18 may be made of any suitable materials known in the art. For example, the umbilical line 18 may be made of materials that form a rigid, sturdy line, or alternatively, the umbilical line 18 may be made from materials that provide flexibility. In one embodiment, umbilical line 18 may be flexible enough to withstand multiple unwindings from a winding device (not shown) as a load is lowered via the lifting device (not shown). The winding device (not shown) may include devices known to those of an ordinary skill in the art, such as a drawworks winch or an auxillary winch.

As shown in FIG. 2, the umbilical line 18 may also include a plurality of other lines such as a combination of the electrical line 19, the hydraulic line 20, and the water line 21. In the scope of embodiments disclosed herein, the umbilical line 18, and any lines contained therein, may be sufficient in length to extend at least the entire distance from the surface vessel to the cutting module 10, after the cutting module is secured to the wellhead 4. Power and/or hydraulics required for operation of the cutting module 10 (including power required by a motor assembly 13) may be delivered to the wellhead 4 by the connections extending from the surface vessel to the wellhead 4 provided via the umbilical line 18.

Figure 3:
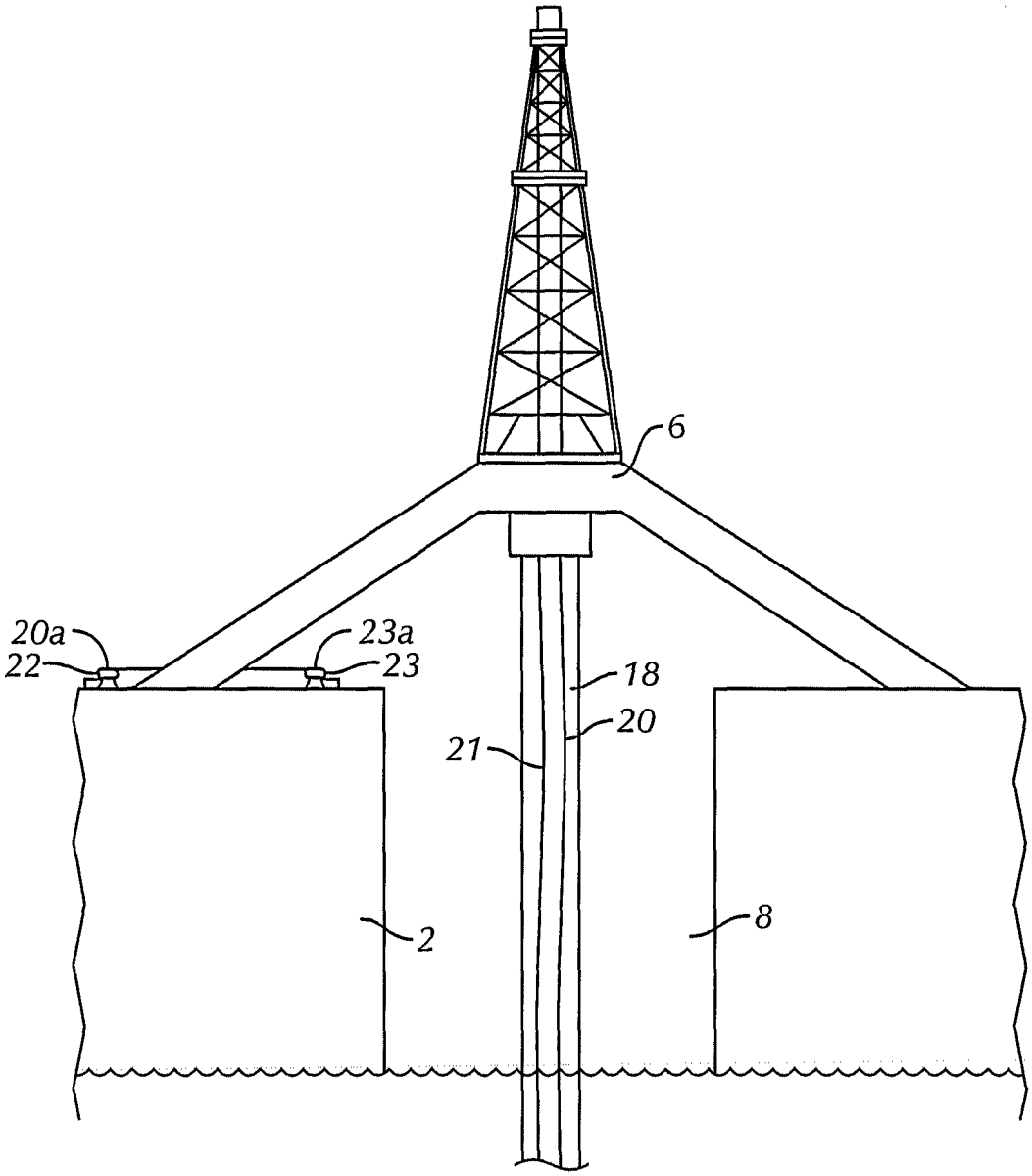
FIG. 3 shows a cross-section of a lifting device attached to a surface vessel, in accordance with embodiments of the present disclosure.

Also referring to FIG. 3, a cross-section of a lifting device attached to a surface vessel according to embodiments of the present disclosure, is shown. FIGS. 2 and 3 together show that the surface vessel 2 may have at least one hydraulic pump 22, which may be used to supply pressurized fluids through the hydraulic line 20. The hydraulic line 20 may have a first end 20*a* that connects to the hydraulic pump 22 located on the surface vessel 2, and may have a second end 20*b* that connects to the cutting module 10. The pressurized fluids supplied by the pump 22 may be used for hydraulically actuating the wellhead connector 12 or components thereof, such as motor assembly 13. In other embodiments, the hydraulic pump 22 may be used for other functions, such as transferring fluids between containers (not shown) located on the surface vessel 2 or transferring fluids between the surface vessel 2 and other vessels (not shown).

FIGS. 2 and 3 also show that the surface vessel 2 may have at least one water pump 23 disposed thereon. In one embodiment, the water pump 23 may be a seawater pump. Similar to the hydraulic pump 22, the water line 21 may have one end 23*a* connected to the water pump 23 located on the surface vessel 2, and a second end 23*b* connected to the cutting module 10. The water pump 23 may be used to run, for example, the motor assembly 13.

Figure 4:
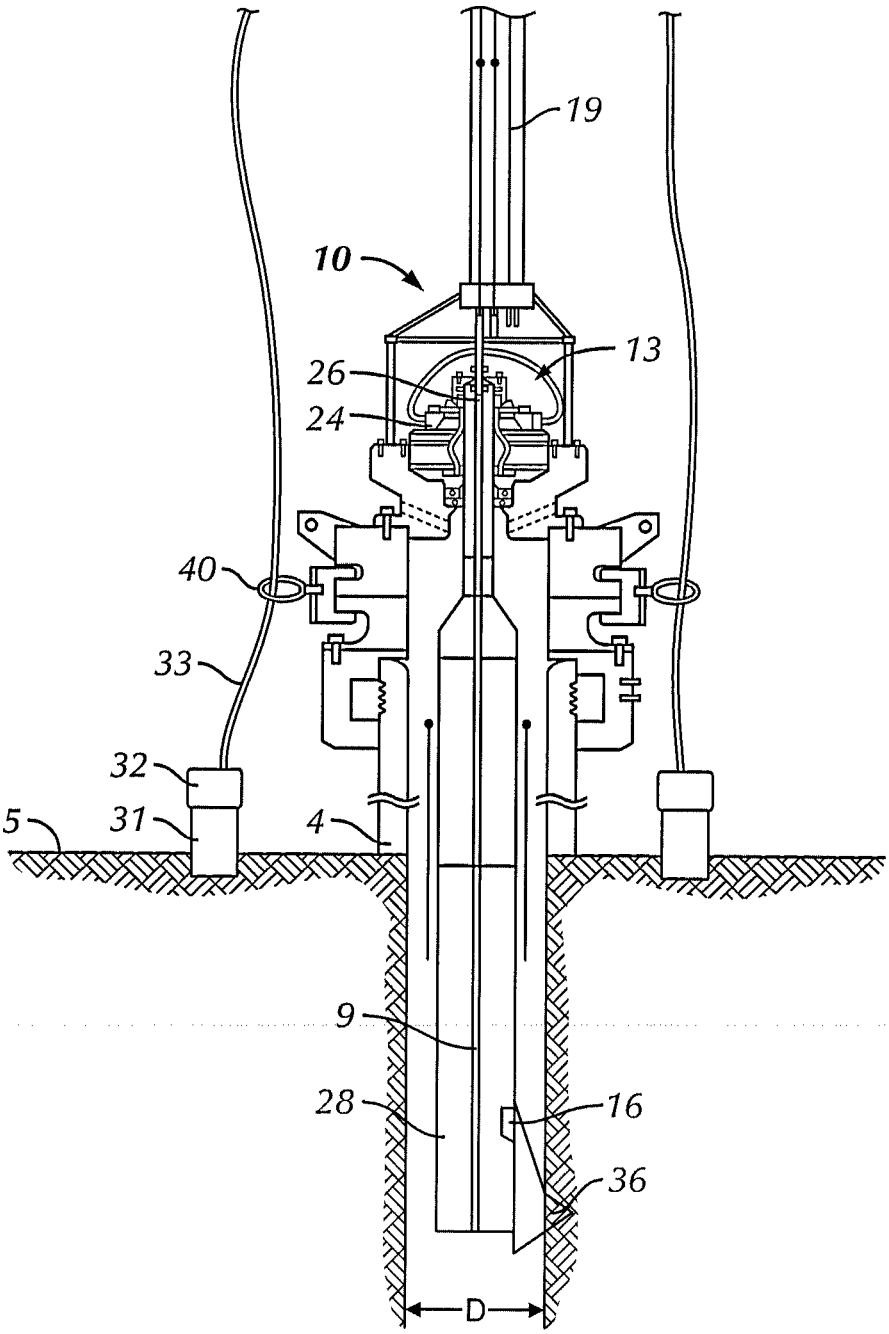
FIG. 4 shows a cross-section of a cutting module secured to a wellhead in conjunction with a guidance mechanism, in accordance with embodiments of the present disclosure.

Referring to FIG. 4, a cross-section of a cutting module secured to a wellhead in conjunction with a guidance mechanism according to embodiments of the present disclosure, is shown. In this embodiment, the motor assembly 13 may include a motor 24, and an output shaft 26 connected to the motor 24. In other embodiments, the motor assembly 13 may also include a tubular 28, wherein the tubular 28 may be configured to operatively connect the output shaft 26 to the cutter 16. In some embodiments, the motor 24 may be a hydraulic driven motor or a mud motor. Such a hydraulic motor may operate within a range of 0 to 300 gpm. In other embodiments, the motor 24 may be an electrical motor, where the electrical line 19 may be used for supplying electrical power thereto. In certain embodiments, the motor may exert up to 15,000 lbs torque.

The motor 24 may be mounted to the cutting module 10 according to any method known in the art. In one embodiment, the motor 24 is mounted to the cutting module 10 by a mounting device (not shown). Accordingly, connections to the cutting module 10, illustrated in the drawings, may be made by flexible connections, such that members extending from the surface to the wellhead do not react to torque forces generated during the cutting operation.

FIG. 4 also shows the cutter 16. While depicted as having a single blade 36, the cutter 16 may also have multiple blades attached thereto. Those of ordinary skill in the art will appreciate that the blades 36 may be formed from any material that is known in the art for casing cutting and subsea service, such as stainless steel or tungsten carbide. In one embodiment, the cutter 16 may be mechanically actuated to engage and cut the casing. In another embodiment, the cutter 16 may be hydraulically actuated. In certain operations, the cutter 16 may be used to cut casing of various diameters, D. In one embodiment, the cutter 16 may be used to cut casing having a diameter in a range of 8 to 36 inches. In another embodiment, the cutter 16 may be used to cut a casing having a diameter of about 9 and ⅝ inches.

The cutter 16 may include radially expandable cutting elements that are driven radially outwardly into engagement with the casing by hydraulic pressure applied via fluid flow through the central bore 9 of the tubular 28. Pressurized hydraulic fluid (e.g., service water, seawater, etc.) may be applied to the cutter 16 via bore 9. In some embodiments, the fluid from the bore 9 may also be used to cool the cutting blades 36 of the cutting device and to flush debris away from the blades 36. Embodiments disclosed herein are not limited to the cutter as described, and those skilled in the art will appreciate that other cutting devices, including various geometries and orientations, may be used.

FIG. 4 also illustrates a method of guiding the cutting module 10 to the wellhead 4. Guiding the cutting module 10 may be useful when seas are turbulent or when a cutting operation needs to be performed expeditiously. As illustrated, the system may include a set of guide piles 31 embedded into the sea floor 5 and located proximate the wellhead 4. There may further be a set of corresponding guide connectors 32 disposed on the guide piles 31. In one embodiment, a set of corresponding connector lines 33 may be removably attached to the guide piles 31 and extend upwardly to a set of second connectors (34 of FIG. 1) disposed on the surface vessel (2 of FIG. 1). The connector lines 33 may also attach to the cutting module 10. For example, the connector lines 33 may traverse a set of eyelets 40 disposed on the cutting module 10. The eyelets 40 and connector lines 33 may operate together to keep the cutting module 10 properly oriented as it is deployed toward the wellhead 4, or oppositely, as the cutting module 10 is raised to the surface.

Figure 5:
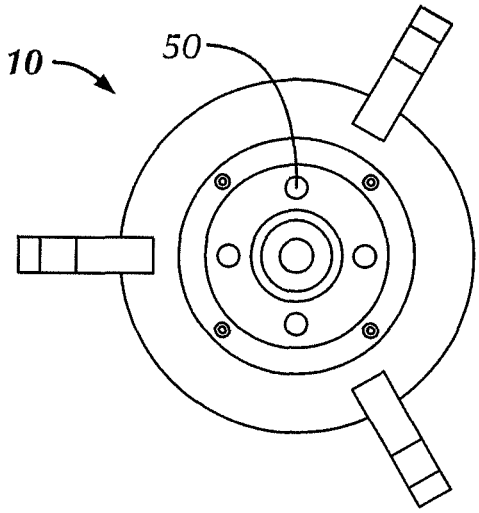
FIG. 5 shows a downward looking view of the cutting module, in accordance with embodiments of the present disclosure.

Referring to FIG. 5, a downward view of the cutting module according to embodiments of the present disclosure, is shown. In this embodiment, there may be a plurality of longitudinally extending water flow areas 50 disposed on the cutting module 10. In certain aspects, the flow areas 50 may facilitate the deployment of the cutting module 10. The flow areas 50 may be generally circular and extend through the cutting module 10 so that the flow areas reduce resistance from the surrounding seawater as the module is raised or lowered from the surface vessel 6 (FIG. 1).

Figure 6:
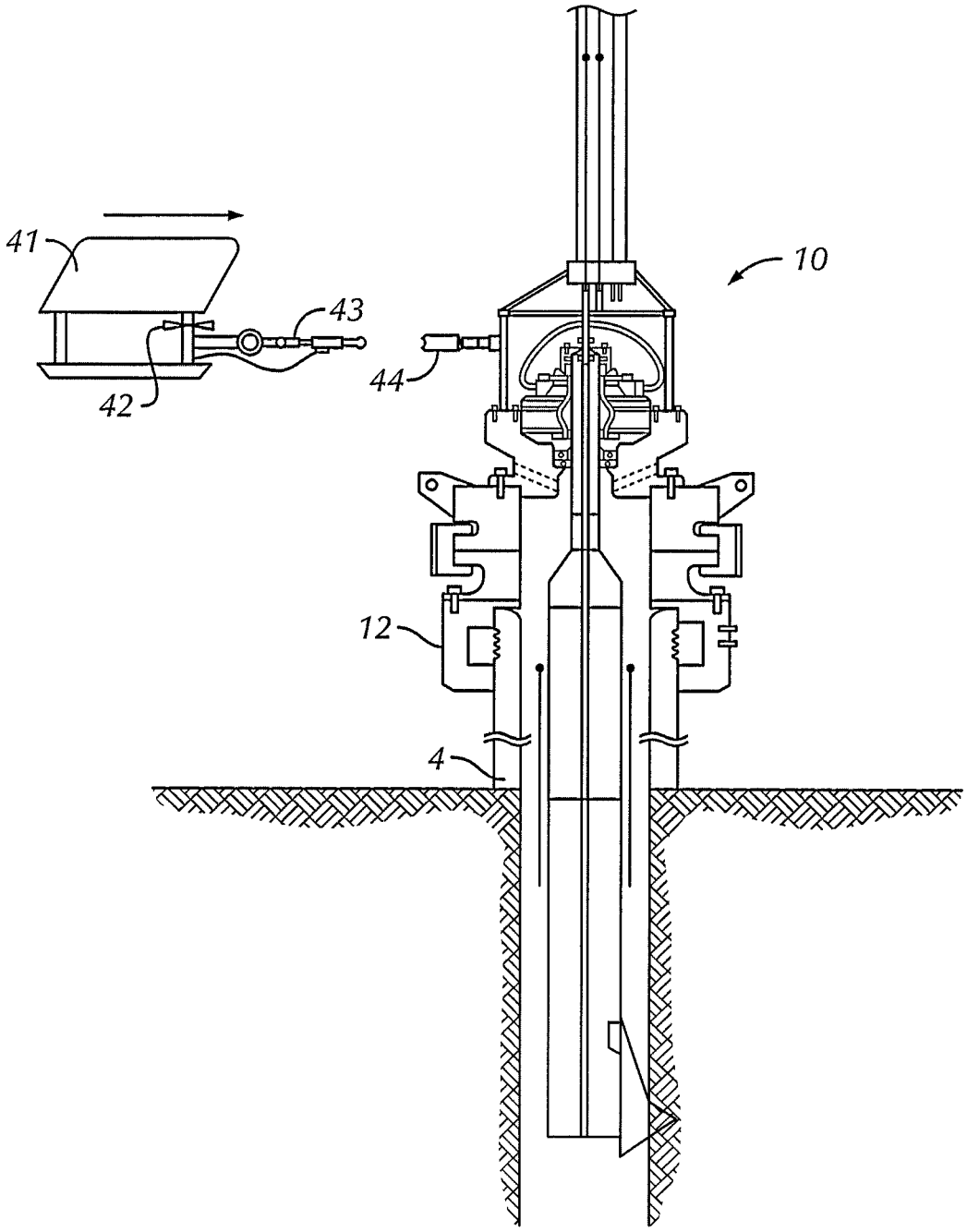
FIG. 6 shows a cross-section of a cutting module secured to a wellhead in conjunction with a remotely operated vehicle, in accordance with embodiments of the present disclosure.

Referring to FIG. 6, a cross-section of a cutting module secured to a wellhead in conjunction with a remotely operated vehicle ("ROV") according to embodiments of the present disclosure, is shown. In this embodiment, the ROV 41 may be equipped with a camera 42 and may be operable at any depth. Additionally, a diver (not shown) may assist in securing the cutting module 10 to the wellhead connector 12. In some embodiments, the ROV 41 may have a connector device 43 for connecting to a ROV interface 44 disposed on the cutting module 10. In other embodiments, the ROV 41 may be used for additional operations, such as determining whether the casing has been completely cut.

Embodiments disclosed herein also pertain to a method for performing rigless casing cutting and wellhead removal operations. The method may include various steps, such as positioning a surface vessel proximate a subsea wellhead. In one embodiment, the surface vessel may be a drilling supply vessel ("DSV"). A DSV may provide multipurpose versatility and operational flexibility. In some embodiments, DSV's may be used for pulling and/or carrying heavy loads. However, the type of vessel used in embodiments of the method disclosed herein is not limited to a DSV. In other embodiments, the surface vessel may include a moonpool and a lifting device.

The method may also include providing a cutting module for removing a wellhead, where the cutting module may include a wellhead connector and an actuatable lock and release mechanism. The cutting module may also include other features, such as a motor assembly and a cutter.

In one embodiment, the method may include deploying the cutting module through the moonpool, where the cutting module is connected to the surface vessel by an umbilical line. Controlled deployment of the cutting module through the moonpool toward the wellhead may be accomplished by any means known in the art. In addition to providing the connection between the cutting module and the vessel, the umbilical line may serve other purposes. For example, the umbilical line may be used as an isolated conduit, so as to provide a protective bather surrounding components internal to the umbilical line.

The method may further include guiding the cutting module into an operative position, such that the cutter may be located within a casing located below the wellhead. For example, the method may include using a set of guide piles and a set of corresponding guide connectors disposed on the guide piles to guide the cutting module into an operative position on the subsea wellhead. The guide piles may be embedded into the sea floor and located proximate the wellhead. There may also be a set of corresponding connector lines removably attached to the guide piles, and extending upwardly to a set of second connectors disposed on the surface vessel. The connector lines may also attach to the cutting module, such that the connector lines may traverse through a set of eyelets disposed on the cutting module. The eyelets and connector lines may operate together to keep the cutting module properly oriented as it is deployed toward the wellhead, or alternatively, as the cutting module is raised to the surface.

After the cutter is properly positioned within the casing, the method may include activating the lock and release mechanism, thereby securing the cutting module to the subsea wellhead via the wellhead connector. The cutter may include radially expandable cutting elements that are driven radially outwardly into engagement with the casing by a supply of hydraulic pressure. Pressurized hydraulic fluid (e.g., service water, seawater, etc.) may be applied to the cutter via a bore within the cutting module.

In some embodiments, a pump may be used for supplying pressurized fluid to the cutter for enabling cutting of the casing. Further, while the cutter may use hydraulic actuation, the cutter may also use mechanical actuation to engage and cut the casing. For example, once the cutter is expanded into engagement with the casing, a motor on the cutting module may be activated to rotate the output shaft and cutter, thereby cutting the casing. In certain aspects, the fluid from the bore may also be used to cool the cutting blades of the cutter and to flush debris away from the blades. While the cutting may be done with the cutter consisting of a single blade, the cutter may also have multiple blades attached thereto.

Once the casing has been cut, the method may further include ceasing the operation of the motor; actuating the lock and release mechanism to unlock the cutting module from the subsea wellhead; disconnecting the cutting module from the wellhead connector hub; and lifting the cutting module to the surface vessel by pulling up the umbilical line.

Alternatively, once the casing has been cut, the method may include ceasing the operation of the motor; removing the cutting module and subsea wellhead from a wellbore while they are secured to one another; and lifting the cutting module and subsea wellhead to the surface vessel by pulling up the umbilical line.

Methods disclosed herein may further include performing at least one of the providing, deploying, guiding, or expanding steps with a remotely operated vehicle ("ROV"). The ROV may be equipped with a camera and/or may be operable at any depth. In one embodiment, a diver (not shown) may be used with the ROV in securing the cutting module to the wellhead connector. In certain embodiments, the ROV may have a connector device for connecting to an ROV interface disposed on the cutting module. In still other embodiments, the ROV may be used for performing additional steps, such as determining whether the casing has been completely cut.

Advantageously, removing the cutting module and subsea wellhead while they are secured to one another may provide the advantage of removing both in a single trip. Further, the present disclosure may advantageously provide embodiments including a surface vessel that may be positioned to provide improved support and stability for a rigless abandonment system. A surface vessel having a centralized moonpool may also allow for greater loads to be deployed to a wellhead.

Other benefits and advantages of embodiments disclosed herein includes a wellhead removal technique that may be used during abandonment of a subsea oil or gas well, which does not require the use of explosive charges. Thus, the rigless abandonment system may provide improved environmental benefits.

While the present disclosure has been described with respect to a limited number of embodiments, those skilled in the art, having benefit of the present disclosure will appreciate that other embodiments may be devised which do not depart from the scope of the disclosure described herein. Accordingly, the scope of the disclosure should be limited only by the claims appended hereto.

What is claimed:

1. A rigless abandonment system comprising:
- a drilling supply vessel comprising:
  - an attached lifting device capable of, with the drilling supply vessel, raising loads weighing up to at least 200,000 pounds; and
  - a moonpool;
- a cutting module configured to connect to a subsea wellhead, the cutting module comprising:
  - a wellhead connector having an actuatable lock and release mechanism, wherein the wellhead connector is actuatable from the drilling supply vessel;
  - a motor assembly; and
  - a cutter: and
- an umbilical line connecting, the cutting module to the drilling supply vessel, wherein the lifting device is used to raise and lower the cutting module connected to the drilling supply vessel through the moonpool,
- wherein the rigless abandonment system is configured to connect the cutting module to the subsea wellhead, cut a section of casing, and remove the subsea wellhead in a single umbilical line trip.

2. The system of claim 1 wherein the drilling supply vessel comprises:
- at least one hydraulic pump.

3. The system of claim 2, wherein the lifting device comprises a crane.

4. The system of claim 2, further comprising:
- a set of guide piles located near the wellhead; and
- a set of corresponding guide connectors disposed upon the guide piles, wherein a set of corresponding connector lines are removably attached to the guide piles and extend upwardly to a set of second connectors disposed on the drilling supply vessel.

5. The system of claim 2, wherein the umbilical line further comprises:
- an electrical line;
- a hydraulic line; and
- a water line,
- wherein the umbilical line, electrical line, hydraulic line, and water line are all sufficient in length to extend at least an entire distance from the drilling supply vessel to the cutting module after the cutting module is secured to the wellhead.

6. The system of claim 5, wherein the hydraulic line has a first end that connects to the hydraulic pump located on the drilling supply vessel and a second end that connects to the cutting module to provide hydraulic activation of the wellhead connector.

7. The system of claim 5, wherein the water line has one end connected to a water pump located on the drilling supply vessel, and a second end connected to the cutting module.

8. The system of claim 1, wherein the motor assembly comprises:
- a motor;
- an output shaft connected to the motor, and
- a tubular, wherein the tubular is configured to connect the output shaft to the cutter.

9. The system of claim 1, further comprising:
- at least two eyelets disposed on the cutting module,
- wherein the at least two eyelets maintain the cutting module properly oriented as it is deployed toward the wellhead.

10. A method for performing rigless casing cutting and wellhead removal operations, the method comprising:
- positioning a drilling supply vessel above a subsea wellhead, the drilling supply vessel comprising a moonpool and a lifting device, the drilling supply vessel and lifting device being capable of raising loads weighing up to at least 200,000 pounds;
- providing a cutting module comprising:
  - a wellhead connector having an actuatable lock and release mechanism;
  - a motor assembly comprising a secured motor; and
  - a cutter operatively connected to an output shaft of the motor assembly;
- deploying the cutting module through the moonpool, wherein the cutting module is connected to the drilling supply vessel by an umbilical line;
- guiding the cutting module into an operative position using a remotely operated vehicle that includes a camera so that the cutter is located within a casing;
- engaging the cutting module with the subsea wellhead;
- actuating the lock and release mechanism from the drilling supply vessel to secure the cutting module to the subsea wellhead;
- expanding the cutter into engagement with the casing;
- operating the motor to rotate the output shaft and cutter to cut the casing;
- ceasing the operation of the motor;
- removing the cutting module and subsea wellhead from a wellbore while they are secured to one another; and lifting the cutting module and subsea wellhead to the drilling supply vessel by pulling up the umbilical line, wherein the deploying, guiding, engaging, actuating, expanding, operating, ceasing, removing, and lifting are performed in a single umbilical line trip.

11. The method of claim 10, further comprising supplying pressurized fluid to the cutting module.

12. The method of claim 10, further comprising:

actuating the lock and release mechanism to unlock the cutting module from the subsea wellhead;

disconnecting the cutting module from the well head connector hub, and lifting the cutting module to the drilling supply vessel by pulling up the umbilical line.

13. The method of claim 10, further comprising performing at least one of the providing, deploying, guiding, or expanding with a remote operated vehicle operable at any depth.

14. The method of claim 10, further comprising:

using a set of guide piles and a set of corresponding guide connectors disposed upon the guide piles to guide the cutting module into an operative position.

15. The method of claim 10, wherein the umbilical line between the drilling supply vessel and the cutting module comprises:

an electrical line;

a hydraulic line; and a water line, wherein the electrical, line, the hydraulic line, and the water line are disposed within the umbilical line.

16. The method of claim 10, wherein the umbilical line between the drilling supply vessel and the cutting module comprises:

an electrical line;

a hydraulic line; and a water line, wherein the electrical line, the hydraulic line, and the water line are disposed within the umbilical line.

17. A rigless abandonment system comprising:

a drilling supply vessel having a lifting device and a moonpool, the drilling supply vessel and lifting device being capable of raising loads weighing up to at least 200,000 pounds;

a cutting module configured to connect to a subsea wellhead, the cutting, module being configured to be raised and lowered by the lifting device of the drilling supply vessel through the moonpool, the cutting module including:

a wellhead connector having a lock that is actuatable from the drilling supply vessel;

a plurality of longitudinally extending water flow areas adapted to facilitate deployment of the cutting module, a motor assembly; and a cutter; and an umbilical line connecting the cutting module to the drilling supply vessel, wherein the rigless abandonment system is configured to connect the cutting module to the subsea wellhead, cut a section of casing, and remove the subsea wellhead in a single umbilical line trip.

18. The rigless abandonment system of claim 17 wherein the plurality of longitudinally extending water flow areas are generally circular.

19. The rigless abandonment system of claim 17 wherein the plurality of longitudinally extending water flow areas extend through the cutting module to reduce resistance from surrounding seawater as the cutting module is raised or lowered from the drilling supply vessel.

* * * * *